US007591376B2

(12) United States Patent
Eisner et al.

(10) Patent No.: US 7,591,376 B2
(45) Date of Patent: Sep. 22, 2009

(54) METHODS FOR FRACTIONATING A MACHINING SUSPENSION USING DESTABILIZATION AND SEPARATION STEPS

(75) Inventors: Peter Eisner, Freising (DE); Michael Menner, Eichenau (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 107 days.

(21) Appl. No.: 11/629,539

(22) PCT Filed: Jun. 10, 2005

(86) PCT No.: PCT/EP2005/006271

§ 371 (c)(1),
(2), (4) Date: Dec. 14, 2006

(87) PCT Pub. No.: WO2005/123888

PCT Pub. Date: Dec. 29, 2005

(65) Prior Publication Data

US 2008/0016783 A1 Jan. 24, 2008

(30) Foreign Application Priority Data

Jun. 16, 2004 (DE) ..... 10 2004 028 785
Feb. 17, 2005 (DE) ..... 10 2005 007 368

(51) Int. Cl.
*B03B 7/00* (2006.01)
*C02F 1/00* (2006.01)
*B01D 35/18* (2006.01)

(52) U.S. Cl. ..... 209/12.1; 210/632; 210/774

(58) Field of Classification Search ..... 210/632, 210/712, 737, 749, 770, 774, 805, 406; 451/36, 451/60, 446; 209/1, 3, 11, 12.1, 223.1, 223.2, 209/238, 248
See application file for complete search history.

(56) References Cited

U.S. PATENT DOCUMENTS 3,618,272 A 11/1971 Whalen et al.
3,997,359 A 12/1976 Dankoff et al.
4,257,902 A 3/1981 Singer et al.
5,126,051 A * 6/1992 Shell et al. ..... 210/632
5,527,204 A * 6/1996 Rhoades ..... 451/40
6,001,265 A * 12/1999 Toyama et al. ..... 210/712
6,010,010 A * 1/2000 Heinle et al. ..... 209/12.1
6,391,072 B1 * 5/2002 Garg ..... 51/309
6,794,340 B2 * 9/2004 Nguyen et al. ..... 507/110
6,821,437 B1 * 11/2004 Eisner et al. ..... 210/695
2008/0176770 A1 * 7/2008 Sanders et al. ..... 507/213

FOREIGN PATENT DOCUMENTS

CA 2150856 A1 * 12/1995
EP 0 322 721 A 7/1989
EP 0 686 684 A 12/1995
EP 0 786 317 A2 7/1997
EP 0 791 385 A 8/1997
EP 0 916 463 A1 5/1999
EP 1 004 653 A 5/2000
JP 09-109144 4/1997
WO WO-01/43933 A1 6/2001

OTHER PUBLICATIONS

Lantto Raiji et al., "Effect of enzymatic treatment on filterability of PGW-concentrate" XP002343651 Database accession No. E2003217473784 abstract & Paperi Ja Puu; Paperi Ja Puu/Paper and Timber 2003, vol. 85, No. 3, 2003, pp. 154-157.
International Search Report dated Sep. 8, 2005, issued in PCT/EP2005/006271.

* cited by examiner

*Primary Examiner*—Duane Smith
*Assistant Examiner*—Paul J Durand
(74) *Attorney, Agent, or Firm*—Venable LLP; Robert Kinberg; Matthew E. Kelley

(57) ABSTRACT

The invention relates to a matrix liquid for producing machining suspensions, a machining suspension produced with the matrix and a method of fractionating the used machining suspension yielded after use. The invention also relates to a homogeneous mixture of a polymer or various polymers and water. The mixture can be used especially advantageously in all technical applications requiring a liquid with lubricating properties. In the present invention, a mixture of water and a thickening agent, respectively a polymer or a multiplicity of polymers, is utilized as the matrix liquid or lubricating liquid. The cutting grains can be separated very easily and quickly from the used machining suspension produced with this matrix liquid; for reuse. Less process water is required and the process water can be simply purified as there is no complicated getting rid of an alcohol charge.

3 Claims, No Drawings

METHODS FOR FRACTIONATING A MACHINING SUSPENSION USING DESTABILIZATION AND SEPARATION STEPS

TECHNICAL FIELD

The present invention relates to a matrix liquid for producing machining suspensions, a machining suspension produced with the matrix and a method of fractionating the used machining suspension obtained after use. The present invention also relates to a homogeneous mixture of a polymer or various polymers and water. The mixture can be used especially advantageously in all technical applications requiring lubricating properties from a liquid.

Machining suspensions comprise a matrix liquid in which a fine-particle solid matter fraction is suspended, which is composed of sharp-edged and hard particles of cutting grain such as diamond, corundum, or silicon carbide and, under circumstances, a fraction of abraded particles of the machined material and the tool. Machining suspensions are used in the field of cutting production of metal materials or in machining and separation lapping of brittle hard materials such as ceramics, quartz and silicon.

Cutting production processes using machining suspensions are, among others, polishing, lapping, separation lapping, wire-sawing, sanding, burnishing and other processes in which fine chips are removed from solid material.

When employing machining suspensions in the areas of lapping, separation lapping and burnishing, suspensions are conveyed to the site at which they are able to develop their cutting effect. The to-be-machined work pieces are brought into contact with the work piece under pressure, if need be with the aid of a tool, for example a wire saw and a work piece. The relative movement between the cutting grains and/or the tool and the work piece cuts fine chips from the to-be-machined material and passes them into the machining suspension. The matrix liquid contained in the machining suspension, referred to hereinafter as the liquid, ensures that the cutting grains and the abraded particles in the machining suspension are present homogeneously and stably dispersed. Moreover, the liquid ensures that the chips are removed from the machining site and the rise in temperature at the machining site is limited.

During machining, the portion of abraded particles from the work piece (and under circumstances from the tool) increase in the machining suspension. When the abraded-particle content has reached a defined ratio of the suspension, the use properties of the suspension change and the machining suspension has to be taken out of the process and discarded. At this point, a great part of the expensive cutting grains in the suspension are unused. As they are stably dispersed in the suspension, they can only be separated from the suspension with a great amount of effort. After separation, the cutting grains can be employed, for example in the case of silicon carbide, for producing a new machining suspension or for other technical uses such as producing ceramics, fireproof materials, abrasive wheels or abrasive papers. However, this requires strict separation between the individual fractions of the content materials of the machining suspension.

The following table shows typical ranges of the composition of a machining suspension.

| Fraction of content materials of machining suspension | Typical amount in percentage by mass |
|---|---|
| Matrix liquid | 20% to 98% |
| Cutting grains, such as e.g. silicon carbide, corundum, diamond or others | 2% to 65% |
| Abraded particles from the work piece and the tool, such as silicon, Fe-metals and non-Fe-metals | 0% to 40% |

PRIOR ART

According to the state of the art, machining suspensions are produced by mixing a matrix liquid with particles of cutting grains. Usually the aim is to disperse the cutting grain fraction as stably as possible in the liquid during use of the suspension. The cutting grain fraction does not deposit on the bottom of the receiver tank or in the feeding lines of the suspension.

Most of the employed machining suspensions remain stably dispersed for hours, sometimes even for weeks without sedimentation of the solid materials. This is achieved especially if the machining suspensions contain highly viscous matrix liquids. Used are matrix liquids with viscosities of above 10 mPa s at 20° C.—in separation lapping applications, liquids between 10 mPa s and 150 mPa s. In some instances liquids with viscosities up to 5.000 mPa s. Mixing fine-particle cutting grains with an average diameter of under 100 μm, preferably 5 to 30 μm, and a viscous liquid yields a stable dispersion machining suspension.

According to the state of the art, the liquid in the machining suspensions comprises alcohol-based liquids such as polyglycols or straight liquids, such as mineral oils.

Examples of alcohols used in machining suspensions are dipropylene glycol and polyethylene glycol such as for example PEG 200. Used as mineral-oil-based matrix liquids are, among others, cutting oils from crude oil raffinates or synthetic-hydrocarbon-based liquids—or even biogenic olefin-based liquids.

These liquids are very expensive. No machining suspensions are known based on inexpensive liquids in these areas of cutting production.

According to the state of the art, water is not used as the matrix liquid, because water lacks the viscosity to form a stable machining suspension.

Following machining the work pieces with the machining suspension, the work pieces have to be cleaned and the suspensions and the matrix liquid have to be removed from the work pieces. The cleaning requirements, for example, in separation lapping of silicon blocks to silicon discs are especially high.

When using machining suspensions containing matrix liquids with an oil content, the cleaning effort is especially great as oils cannot be washed off the work pieces with water. Organic solvents or special aqueous tenside solutions are needed, partially with the aid of ultrasound, mechanical shear forces or raised temperatures. Machining and cleaning of charged scouring liquids has to occur on the basis of chemical, thermal, distillative or physical cleaning methods, as oily scouring liquids cannot be treated in biological sewage plants.

Removal of alcohol-based machining suspensions from the surface of the work pieces is simple, as the alcohol-based matrix liquid can in many cases be mixed with water. The matrix liquid and the particles pass into the scouring water.

Apart from contaminating the water with the cutting grains and the abraded particles, this leads to high organic contamination of the effluent as alcohols are highly concentrated organic liquids. The cost and effort to purify the effluent is very great corresponding to the high organic charge.

In addition to the cost and effort of purifying the effluent related to cleaning the surfaces of the work pieces, a great amount of expensive, unused cutting grains is lost in disposing of the machining suspensions. In order to avoid this loss, machining suspensions should be composed in such a manner that removal, in particular, of the cutting grain fraction from the suspension and reuse of the cutting grains is possible in a simple manner. Presently, this is only possible with great technical effort.

The methods according to EP 0786317 A2, U.S. Pat. No. 3,997,359 A, EP 0916463 A1, WO 01/43933 A and the patent abstract of JP 09-109144 permit fractionating the used machining suspensions and to some extent recovering the cutting grain fraction, however, their application to cooling lubricants according to the state of the art—thus to alcohols and oils—is very complicated and expensive. Consequently, only fractionating of oil suspensions is used for reducing the viscosity by means of organic solvents such as kerosene or hexane. In order to fractionate alcohol-based machining suspensions, water in great excess is added—up to 20 times the amount of the machining suspension—to reduce the viscosity of the machining suspension and to enable to wet-classify the solid matter particles in the diluted aqueous, alcoholized system. In reducing the viscosity with solvents, a large amount of oil passes into the organic solvent. The process water used for reducing the viscosity is contaminated with great amounts of alcohol. Putting the matrix liquid into the process water entails great effort and cost to purify the water. As a result, these methods are unsuited for cost-effective separation of the machining suspension.

In another technical field, there are lubricating liquids known which are largely composed of crude oil fractions, synthetic oils, esters of fatty acids, true oils and fats or contain such oils or fats. Due to their viscosity and their wetting properties, the oils ensure that friction and wear are reduced at the point of contact between two solid matters moving against each other.

An advantage in using oils is their long-term stability. They are used, sometimes for months or for years, for example as grain oils or hydraulic oils, without noticeably changing their properties or biological degradation setting in.

A disadvantage of such oils is the high costs involved with them and their environmental incompatiblity that they are largely classified as hazardous and require special monitoring during transport and disposal.

If oils are mixed with water to lower costs and emulsified/stabilized with the aid of emulsifiers, the lubricating properties change quickly, for example by demixing or biological decomposition of at least some of the organic components. Such mixtures are therefore not stable in the long term and cannot be used for application, for example as a hydraulic oil or as a cooling lubricant, where they have to remain in the processing machines for long periods.

Mixtures of water, emulsifiers and oils, therefore, always have to be made preservable with preservatives. However the latter should be avoided for safety reasons, as they may cause irritations, allergies and rashes, thus in some cases posing a massive health risk to the staff operating the processing machines.

Another disadvantage of lubricants with an oil content is that oil is very difficult to wash off surfaces. Machined metal parts, which for example need to be thoroughly cleaned before painting have to be washed with much effort in concentrated tenside solutions or solvents, resulting in high costs and large amounts of contaminated scouring water or solvent. Due to, among other things, their oil content, these liquids have to undergo specially monitored waste disposal, causing additional high costs.

An object of the present invention is to provide a matrix liquid for producing dispersion-stabile machining suspensions, a machining suspension producible with the matrix liquid and a method of fractionating the machining suspension after its use avoiding the drawbacks of the prior art. Another object of the present invention is to provide a liquid which has lubricating properties for application on metals and for hydraulic applications and which is stable in the long term, not or not readily biologically degradable, low cost, can be readily washed off the surface of a tool or work piece and is not a hazardous material.

In particular, the liquid should be easy to remove from the surfaces of the work piece. Moreover, there should be only a minimal organic charge passed into the scouring water when treating the scouring water from cleaning the work piece. Fractionating the machining suspension to recover the expensive cutting grains should be easy to carry out and use of concentrated organic matrix liquids obviated.

DESCRIPTION OF THE INVENTION

The object is solved by using a matrix liquid or mixture with the properties described herein, by the machining suspension described herein and by the method of fractionating the machining suspension described herein. For example, embodiments of the present invention describe a method of treating the mixture used as a lubricating liquid or machining liquid, facilitating washing off and the biological degradability of the lubricating liquid or machining liquid after use. Advantageous embodiments of the invention are the subject matter of the subordinate claims or can be drawn from the subsequent description and preferred embodiments.

The invented liquid for producing a machining suspension is a mixture of water and a thickening agent, which is soluble or dispersible in water and which increases the viscosity of the liquid in such a manner that the liquid is suited, after being mixed with cutting grains and, under circumstances, with abraded particles to form a stable metal cutting suspension.

Remarkably, the thickening agents, known from applications in the fields of nutrition, pharmaceuticals and cosmetics, can also be used to produce matrix liquids for machining suspensions. A special advantage in using water-based matrix liquids is the higher thermal capacity of water compared to alcohols and oils, yielding a better cooling effect at the cutting site.

In principal, the following can be employed as thickening agents:

- natural organic thickening agents such as agar-agar, carrageen, tragacanth, gum arabic, alginates, pectins, polyoses, guar meal, carob seed grain meal, starch, cellulose, dextrins, gelatin, casein;
- modified organic natural substances such as carboxy methyl celluloses and other cellulose ethers, celluloses, hydroxyethyl celluloses and hydroxypropyl celluloses and other modified celluloses of this type or grain meal ethers;
- completely synthetic organic thickening agents such as polyacryllic compounds and polymethacryllic compounds, vinyl polymers, polycarbonic acids, polyethers, polyimines and polyamides and inorganic thickening agents such as polysilica acids, clay minerals such as montmorillonites, zeolites, silica acids; and mixtures of various thickening agents.

In principal, all substances which increase viscosity when mixed with water, thus also sugar and salts, are suited as thickening agents for the invented liquid.

The invented lubricating liquid and machining liquid, referred to in the following as liquid or lubricating liquid, is a mixture of water and a polymer additive which is soluble or dispersible in water and which gives the liquid a lubricating property.

Remarkably, particularly thickening polymers, known, ia., from the fields of nutrition, packaging, pharmaceuticals and cosmetics can also be used to produce liquids which are suited for use in applications in which lubricating oils or oil emulsions have hitherto been employed.

Preferably the lubricating liquid contains only water and the mentioned one or multiple polymers and, under circumstances, other substances that do not influence the lubricating effect, for example preservatives.

An advantage in using water-based lubricating liquids is the high thermal capacity of water compared to oils, permitting a better cooling effect at the friction site.

In principal, thickening and viscosity-modifying polymers can be used as polymers, such as:

natural organic polymers, such as carrageen, pectins, polyoses, starch, celluloses, dextrins, gelatin, casein;

modified natural organic polymers, such as carboxy methyl celluloses and other cellulose ethers, hyroxyethyl cellulose, hydroxypropyl cellulose and other modified celluloses;

completely synthetic organic polymers, such as polyacryllic compounds and polymethacryllic compounds, vinyl polymers, polycarbonic acids, polyethers, polymines, polyamides;

inorganic polymers, such as polysilicic acids; and mixtures of various of these polymers.

In most of the applications, the concentration of the thickening agent or polymer does not exceed values of 25% by mass. Advantageous concentrations of the thickening agents or polymers are less than 10% by mass, special advantages result if less than 5% by mass is used. There are particularly efficient thickening agents or polymers which are used with less than 1% by mass. The polysacharide xanthan possesses with even less than 0.25% by mass at 40° C. with approximately 40 mPa s the same viscosity as polyethylene glycol 200 or a commercial lubricating oil. In order to produce the present lubricating liquid, it is possible to adapt viscosities of 1 mPa s exactly to the respective application by varying the polymer concentration. This is not so simple using conventional oils, as individual fractions from crude oil distillation are used for lubrication, which are divided into viscosity classes of approximately 10 mPa s, 20 mPa s and 40 mPa s.

Someone skilled in the art is able to select the suited substances from the mentioned groups of thickening agents or polymers. Thus, the different applications in cutting production make different demands on the matrix liquid. Selection of the thickening agent permits adapting the viscosity, rheological properties and sliding and lubricating properties of the matrix liquid, for example specifically to separation lapping, polishing, lapping processes or other processes of different materials with different cutting grain materials and sizes. The different applications also make different demands on the lubricating liquid. Selection of the polymer permits adapting the viscosity, biological stability, ability to wash off the processed surface and the sliding and lubricating properties to the specific demands and different materials. Thus, varying the concentration of the thickening agent or the polymer or using a different or additional thickening agent or polymer permits selective modification of the properties of the liquid.

By changing the concentration of the thickening agent, a low or high viscosity can be set in the machining suspension, which is not possible with pure state-of-the-art matrix liquids.

By changing the concentration of the thickening agent or the polymer, low or high thermal capacities can be set in the liquids if the matrix liquid or lubricating liquid, respectively the machining liquid, is to have a cooling effect, which is not possible according to the state of the art with either pure matrix liquids or lubricating oils. In the invented matrix liquid or lubricating liquid, it is possible to set a thermal capacity at 20° C. to values above 3 kJ/kgK, in some applications to values above 4.1 kJ/kgK. In comparison, the thermal capacities of state-of-the-art matrix liquids or lubricating oils lie between 1.5 and 2.5 kJ/kgK.

Moreover, the invented matrix liquid or lubricating liquid has advantages for cooling the surfaces of work pieces that high energies can be conveyed away from the work piece by partial evaporation of the water, for example at the machining site. The high evaporation enthalpy of the contained water prevents the work piece from heating up too much. The low concentration of the thickening agent or polymer in the water minimizes contamination of the work piece by the thickening agent left after evaporation, respectively by the residue lubricant.

Special advantages are yielded if the mixture of thickening agent or polymer and water results in a single-phase mixture. In some applications, multiphase systems can lead to demixing, which can alter the stability of the suspension, respectively the properties of the lubricant.

In an especially advantageous embodiment the matrix liquid or lubricating liquid contains natural or modified organic polymers, such as modified celluloses, proteins or polysacharides, such as for example xanthan.

By adding a few percentage by mass of a modified cellulose to water, a liquid can be created which hardly differs in viscosity and rheological behavior as a Newtonian liquid from dipropylene glycol or polyethylene glycol 200 or from spindle oils. Substitution of alcohols or oils with the invented matrix liquid or lubricating liquid is therefore possible without changing hitherto existent processes.

The invented liquid is particularly suited to replace polyglycols in the machining suspension, which are used in the production of silicon discs. These machining suspensions comprise 35 to 65% by mass matrix liquid, 30 to 60% silicon carbide, 7 to 25% abraded silicon particles and up to 5% abraded iron particles from the wire saw. Moreover, to prevent a chemical reaction of the silicon, it can be advantageous to add acids to lower the pH value of the matrix liquid.

Furthermore, only few microorganism-produced enzymes can dissolve the created mixture of water and modified cellulose which is therefore biologically only very difficult to decompose, respectively to degrade. In the laboratory, the mixture of water and modified cellulose was stored at room temperature for more than five months without any change in the viscosity of the liquid. Thus the invented liquid demonstrates good durability.

On the other hand, using xanthan as the thickening agent in the invented liquid has a different surprising effect. This substance mixed with water displays a marked intrinsically viscous behavior. The viscosity in such liquids is less in low shear stress than in high shear stress. Adding less than 1% by mass of xanthan to water permits producing an extremely stable machining suspension, becauss the viscosity of intrinsically viscous liquids is especially high during static stress as is the case, for example, to prevent sedimentation. If the liquid however is subjected to high shear stress, which is present directly at the site of the machining, the apparent viscosity is reduced to values close to the viscosity of pure water. Thus, due to the low viscosity, the liquid at the site of the machining can also penetrate the finest cracks and cavities, which has an especially good cooling and lubricating effect.

Moreover, using the invented liquid allows using simple methods to distinctly reduce the viscosity of the liquid and in this manner permits fractionation of the machining suspension and separation of the cutting grain fraction. In the case of the lubricating liquid, the polymers can be split into small strings of molecules enabling in this way to lower the viscosity and to facilitate washing-off and biological degradablity of the lubricating liquid. Suited therefor are, for example, methods which split the molecules of the thickening agent or polymer. This can be achieved dependent on the thickening agent or polymer, for example by:

- application of mechanical energy, such as for example turrax, stirring; used in machining suspensions, the machining process itself already leads to partial splitting of thickening agent molecules or polymer molecules;
- application of thermal energy, such as thermal hydrolysis methods including under high pressure;
- use of acids or lyes to chemically modify the molecules;
- enzyme treatment or other methods with which the molecules are split whereby, for example, the viscosity of the matrix liquid of the machining suspension is altered.

The viscosity of the matrix liquid of modified cellulose, for example by adding cellulase to the machining suspension, is reduced in such a manner that the machining suspension is destabilized and sedimentation sets in. In advantageous embodiments, the viscosity can be reduced in such a manner that the finest particles, such as the abraded particles, remain suspended, whereas large particles, for example the cutting grains, settle. In combination with wet classification, this effect permits a particularly clear separation between the abraded particles and the cutting grains. Adding water enhances this process.

Another advantageous and simple method of fractionating a machining suspension containing the invented matrix liquid provides in a first step for reduction of the viscosity of the machining suspension by only adding water to destabilize the suspension. Surprisingly, despite the thickening agent contained in the suspension, just adding water can destabilize the machining suspension in such a manner that parts of the solid matter settle. The fine particles of solid matter remain stably suspended, permitting especially clear separation of the solid matter fractions, for example in a following classification of the particles.

The process of destabilization of the machining suspension by adding water can be achieved with less water if some of the matrix liquid or some of the thickening agent is removed from the machining suspension before the water is added. Apart from molecular decomposition, this can also be achieved, for example, mechanically by separation by means of pressing the liquid out or using other methods such as absorption.

It turned out in diluting the suspension with water that the time point of adding the water influenced the viscosity of the resulting diluted suspensions. Different viscosities of the used suspension are yielded if a defined amount of water is added before the machining process than if the identical amount is added after the machining process.

The viscosity of the used machining suspension lowers if, after use of the suspension, the ratio of water to thickening agent is set to the same value by adding water than if the same ratio of water to thickening agent is set by adding water before use. This effect can also be observed if the concentration of solid matter and the amount of fine grains and the amount of coarse grains are identical in both cases.

Reducing the viscosity of the invented liquid and destabilizing the used machining suspension can thus be achieved by:

- diluting the suspension with water and/or
- heating the suspension and/or
- reducing the concentration of the thickening agent.

It may also be advantageous to use several of the described methods to dilute the machining suspension.

The concentration of thickening agents can be reduced

- by enzymatic, thermal, chemical or hydrolytic splitting of the thickening agent and/or
- by previous mechanical separation of a part of the liquid from the suspension and/or
- by refilling the missing liquid with water.

It is much easier and quicker to mix a machining suspension containing the invented matrix liquid with water than all the state-of-the-art machining suspensions containing water-miscible matrix liquids, for example alcohols. Isolation of the particles in the liquid diluted with water—thus spitting up the existent particle agglomerates—can be achieved quicker with the invented machining suspension than with prior-art machining suspensions.

Using the invented liquid reduces the effort of conveying the matrix liquid into the water, and wet classification is simpler. Less process water is required and the process water can simply be purified biologically, obviating ridding the process water of the alcohol with much effort.

In this manner it is much easier to conduct wet particle classification for fractionating the solid matter from a machining suspension containing the invented liquid and it suffices to add less water to achieve the desired classification. In individual cases, classification results can be further improved by adding tensides or salts to the process water employed for dilution.

Clear separation of the cutting grain fraction from the abraded particles and from the liquid by means of wet classification can be achieved using state-of-the-art separation devices such as centrifuges, decanters, hydro cyclones, sedimentation, filtration or other methods of separation and classification.

It is principally also possible to separate the solid matter from the machining suspension into fractions after removal of the liquid, for example by removal of the water by means of drying. All state-of-the-art separation and classification methods, for example classification by drying, air separation, or other methods, can be employed. With the aid of a thermal follow-up treatment, residues of the dried thickening agent can be removed very efficiently from the surfaces of the cutting grains.

Surprisingly, apart from reducing the viscosity, splitting the molecular chains in the matrix liquid can also result in charge shifts, changes in the polarity of the liquid and changes in the wetting properties of the liquid. The charges of the particle surfaces and the formation of particle agglomerates can be influenced in this manner or existent agglomerates can even be destroyed. Decomposition of the thickening agent can thus lead to sedimentation of the cutting particles. On the other hand the fine abraded particles do not agglomerate but remain stably dispersed, thereby further reducing the effort of particle classification. Modification of the properties of the liquid can also be further intensified by adding salts or tensides.

Moreover, it has turned out that by splitting the molecules of the thickening agent, for example by means of enzymatic, thermal or acidic or lye treatment, the biological degradability of the organic charge is also improved in such a manner that it permits simple biological purification of the organic materials. Thus if using a modified cellulose, which cannot be biologically degraded under use conditions, the biological degradability of the invented lubricating liquid can also be improved, for example by adding specific cellulases, in such a manner that the liquid can be simply treated in a biological sewage plant. It is therefore easier and less expensive to purify the effluent yielded by cleaning the work piece or by fractionating the suspension to recover the cutting grains or by discarding the liquid or by discarding the chips. Moreover, due to the low concentration of thickening agents or polymers in the invented liquid, the organic charge of the effluent is 20 to 100 times lower than, for example, when using oils.

Using biologically poorly degradable materials, such as modified cellulases, has the advantage that only few microorganisms are able to form enzymes which are able to degrade biologically. Thus someone skilled in the art is enabled to adjust the environmental conditions in the invented lubricant, such as pH value or oxygen concentration, in such a manner that microorganisms, which are able to form such enzymes, are unable to grow in the liquid. Thus, specific methods of preservation for preventing the growth of microorganisms, which are completely harmless for humans, can be applied, for example, in lowering the pH to a value of about 4.

Using polymers such as celluloses, modified celluloses, starches, modified starches or even proteins or other polymer thickening agents or polymers in the matrix liquid or lubricating liquid has additional advantages.

Splitting the thickening agents or polymers into small fractions, such as sugar, starches or amino acids, yields solutions that are far easier to wash off the work pieces than all the available state-of-the-art matrix liquids or lubricating liquids. Especially in the field of silicon machining or in the field of metal machining, in which subsequent surface treatment by galvanizing, phosphatizing or painting is provided, the surfaces of the work pieces can be cleaned with minimal cleaning effort better than hitherto. As a few percentages by mass of the thickening agent or the polymer in water already suffice to set the desired viscosity and lubricating effect, much fewer organic components need to be removed in cleaning the surfaces of work pieces, for example silicon discs, than is the case, for example, using alcohols as the matrix liquid or lubricating oils. Moreover, the created split products of the thickening agent or polymers, such as sugar, amino acids or other monomers, such as caprolactam from polyamide are much more readily soluble in water and therefore much easier to clean from the surface than state-of-the-art long-chain alcohols or oils or emulsions.

Although very many of the described thickening agents or polymers form biologically stable liquids with water, it can be useful or necessary to add additional preservatives to the liquid to limit or to prevent the growth of microorganisms, for example in a machining suspension. Employed can be preservatives that are known to someone skilled in the art from the fields of cooling lubricant preservation, food preservation or the preservation of cosmetic products.

It may also be useful to change the pH value of the liquid in order to prevent undesired chemical reactions of the tool or work piece, such as for example corrosion. An alkaline environment should be avoided in machining silicon; someone skilled in the art will reduce the pH value of the matrix liquid by adding acid. In the case of various metals, someone skilled in the art will prefer a slightly alkaline environment to protect against corrosion. Fundamentally, the same state-of-the-art additives can be used in the invented liquid, as for example with conventional cooling lubricants. Examples, in addition to the mentioned preservatives and anticorrosives, are EP additives (extreme pressure additives) emulsifiers, stabilizers, solubilizers and other additives.

It may also be advantageous to produce matrix liquids or lubricating liquids from synthetic polymers, such as polyamides or other water-miscible and biologically undegradable or poorly degradable polymers, thereby further improving the biological stability of the matrix liquid or lubricating liquid. Furthermore, it is especially easy to wash off synthetic polymers.

As previously demonstrated, certain enzymes offer advantages for splitting the molecules of polymers. Therefore enzymes are resorted to in an especially advantageous method of pretreating the used liquid, for example before treatment in a biological sewage plant. Use of immobilized enzymes on a base material has the advantage that less enzyme is required and therefore enabling reducing treatment costs further.

The invented liquid can, for example, be used as a cooling lubricant in applications in machining production such as boring, sawing, milling, polishing, turning, planing and other applications. It is possible and, under circumstances desirable to use such liquids as a substitute for conventional water-miscible cooling lubricants, such as cutting emulsions or non-water-miscible cooling lubricants such as cutting oils or spindle oils.

The invented lubricating liquid can also be used in applications as a lubricating hydraulic liquid as a substitute for hydraulic oil. In the prior art oils are employed here almost without exception, because they lubricate, are stable in the long term and are not biologically degraded during operation. The same applies for applications in which motor oils and transmission oils have hitherto been used. The invented liquid can be employed as a substitute for machining oils, for example for rolling sheet metal, punching or deep-drawing metal.

PREFERRED EMBODIMENTS

Example 1

A clear, single-phase matrix liquid is produced from 100 g of water and 2.9 g of modified cellulose. The matrix liquid shows Newtonian behavior and possesses a viscosity Of 35.5 mPa s at 40° C. At this temperature, polyethylene glycol 200 has a viscosity of 35 mPa s. Silicon carbide powder (SiC) with an average particle size of 15 μm is stirred into the generated liquid. A stable suspension forms which does not completely settle even after one day.

After adding 1 g of cellulase, the matrix liquid is stirred at 40° C. After 120 minutes, the viscosity of the liquid is reduced to 2 mPa s. With the aid of the yielded liquid, no stable machining suspension can be produced with the SiC powder. The stirred-in particles settle completely after a few minutes.

Example 2

10 kg of a machining suspension composed of 5 kg of silicon carbide and 5 kg of the matrix liquid produced as in example 1 is produced. The suspension is fed during the wire-saw process to cut silicon wafers from silicon blocks. After discharge of the used suspension, the suspension contains 15% by mass of abraded silicon particles with an average particle diameter of 0.8 μm and 3% abraded particles with an average particle diameter of 2μm from the saw wire.

3 kg of water are added to 1 kg of the used suspension. More than 80% of the SiC particles settle after one hour, the silicon particles largely remain in suspension. After separation of the supernatant from the sediment, the sediment is mixed with an additional 3 kg of water. This mixture is treated with a hydrocyclone. The oversized material from the classification contains less than 1% silicon and iron.

Example 3

10 g of cellulase and 1 kg of water are added to 1 kg of the used suspension from example 2. More than 85% of the SiC particles settle after one hour, the silicon particles largely remain in suspension.

After separation of the supernatant from the sediment, the sediment is mixed with an additional 3 kg of water. This mixture is treated with a hydrocyclone. The oversized material of the classification contains less than 1% silicon and iron.

Example 4

1 kg of the used suspension of example 2 is dried. The dry solid material contains the dry thickening agent, the cutting grain fraction and the abraded particles of iron and silicon. Then the solid material is finely ground and multiply treated with the aid of a wind sifter. The yielded cutting grain fraction contains less than 5% silicon and less than 1% thickening agent. The remaining thickening agent is then separated from the surface of the cutting grain particles in a oven at 400° C. The yielded cutting grains can then be reused in the sawing process.

Example 5

An invented lubricating liquid was produced from 400 g of a modified cellulose and 50 kg of deionized water by stirring in the polymer. The liquid was fed to a machining machine to polish a steel work piece. The lubricating properties regarding depth of coarseness, tool wear and attainable cutting velocity (mass of separated metal per time unit) were practically identical to the lubricating properties obtained on the same day at the same polishing machine when using a conventional state-of-the-art cutting emulsion. In another test at the same polishing machine, pure water was used as a reference lubricating liquid. Just after a few seconds, the polishing disc was completely ruined when pure water was employed.

What is claimed is:

1. A method for fractionating a machining suspension, which contains a mixture of water and thickening agent as a matrix liquid and at least particle-size cutting grains comprising destabilizing the machining suspension by splitting the molecules of the thickening agent in the mixture so that abraded particles remain in suspension and the cutting grains settle as sediment; and then separating a fraction containing the cutting grains from the machining suspension.

2. The method according to claim 1, wherein the splitting of the molecules of the thickening agent uses enzymatic treatment or thermal treatment.

3. The method according to claim 1, wherein the separating of the fraction containing the cutting grains from the destabilized machining suspension uses wet classification.

* * * * *